US006722591B2

(12) United States Patent
Reichler

(10) Patent No.: US 6,722,591 B2
(45) **Date of Patent: *Apr. 20, 2004**

(54) HIGH-SPEED ROTARY ATOMIZER FOR APPLYING POWDER COATING

(75) Inventor: Jan Reichler, Constance (DE)

(73) Assignee: Eisenmann Lacktechnik (DE)

( * ) Notice: Subject to any disclaimer, the term of this patent is extended or adjusted under 35 U.S.C. 154(b) by 97 days.

This patent is subject to a terminal disclaimer.

(21) Appl. No.: 09/999,771

(22) Filed: Oct. 24, 2001

(65) Prior Publication Data

US 2002/0083893 A1 Jul. 4, 2002

(30) Foreign Application Priority Data

Oct. 27, 2000 (DE) ..... 100 53 295

(51) Int. Cl.[7] ..... B05B 5/00
(52) U.S. Cl. ..... 239/700; 239/703; 239/706
(58) Field of Search ..... 239/690–708

(56) References Cited

U.S. PATENT DOCUMENTS 4,228,961 A * 10/1980 Itoh ..... 239/698
4,258,409 A 3/1981 Porter
4,545,536 A * 10/1985 Avidon ..... 239/695
5,820,036 A * 10/1998 Saito ..... 239/703
5,947,377 A * 9/1999 Hansinger et al. ..... 239/703

FOREIGN PATENT DOCUMENTS

EP 0 857 515 8/1998

* cited by examiner

*Primary Examiner*—Dinh Q. Nguyen
(74) *Attorney, Agent, or Firm*—Factor & Partners

(57) ABSTRACT

A high-speed rotary atomizer for applying powder coating includes a housing to the front end of which a bell disc is rotatably mounted. Bell disc is driven by a motor arranged inside housing. At least one powder supply channel passes through housing, and emerges at the front of housing. This channel contains an acceleration jet in which the coating powder particles are accelerated to a higher velocity which is maintained over at least a certain distance. The increased velocity, preferably supported by acceleration air forming a surface layer, prevents coating powder particles from being deposited on the walls of powder supply channel. In this way an insulating section is formed by which a backflash of the high voltage used to ionise the coating powder particles, from the internal electrode of the high-speed rotary atomizer towards the powder supply, is prevented.

9 Claims, 3 Drawing Sheets

HIGH-SPEED ROTARY ATOMIZER FOR APPLYING POWDER COATING

BACKGROUND TO THE INVENTION

1. Field of the Invention

The present invention relates to high-speed rotary atomisers for applying powder coating. Such atomisers comprise a housing; a rotatable bell disc arranged at the front of the housing; a motor driving the bell disc accommodated in the housing; at least one powder supply channel passing through the housing and emerging at the front of the housing; and at least one high-voltage electrode arranged in the housing. The powder particles flowing through the powder supply channel are guided past the at least one high-voltage electrode for ionisation.

2. Background Art

High-speed rotary atomisers with what is called "internal charging" have been increasingly used in recent times. "Internal charging" means that the high-voltage electrode, with which the powder coating particles are ionised, is located inside the housing of the high-speed rotary atomiser. "Internal charging" is in contrast to "external charging", wherein the high-voltage electrode is generally provided outside the housing, in the form of a ring that surrounds the bell disc. With "external charging" the air surrounding the external electrode is first ionised and then the coating powder is indirectly ionised via the air. Such a process has relatively low efficiency. With "internal charging", by contrast, in an "internal charging" system, the coating powder particles are ionised by direct contact with the high-voltage electrode This process takes place with greater efficiency.

With known high-speed rotary atomisers of the kind mentioned at the outset, the coating powder particles flow through the powder supply channel at substantially constant velocity. As this happens coating powder particles are deposited on the walls of the powder supply channel, forming a substantially continuous, thin layer. As long as the coating powder particles have good electrical insulation properties this does not present problems. However, coating powders to which metallic particles are admixed to achieve certain optical effects are being increasingly used. If these metallic particles are deposited on the walls of the powder supply channel in the coating powder layer mentioned, this can lead to a backflash of high voltage from the high-voltage electrode towards the coating powder supply, which it is essential to prevent.

SUMMARY OF THE INVENTION

An object of the present invention is to configure a high-speed rotary atomiser of the type mentioned at the outset, in a simple manner, such that there is no danger of backflash from the high-voltage electrode even when using electrically conductive particles in the powder coating.

In the present invention, the powder supply channel contains an acceleration jet in which the coating powder particles are accelerated to a higher velocity which is maintained over at least a certain distance.

According to the invention it is ensured that the stream carrying the coating powder particles is accelerated in a specific section of the powder supply channel to such high velocity that no particles, and in particular no electrically conductive particles, can be deposited on the walls of the powder supply channel at least in that section. The high velocity, and therefore the cleanliness of the walls of the powder supply channel, must be maintained over such a distance that no backflash across this distance is possible with the high voltages used. In the portion of the powder supply channel located further downstream of the acceleration jet the stream of coating powder particles can decelerate again. If a layer of coating powder particles is deposited there on the surfaces of the powder supply channel, that is not hazardous.

The embodiment in which the acceleration jet has an Inlet through which pressurised acceleration air can be admitted to the passage of the acceleration jet is especially preferred. This additional acceleration air has two effects: firstly, it increases the acceleration of the stream of powder particles; secondly, with suitable aerodynamic guidance it produces an air layer between the wall of the powder supply channel and the coating powder stream located radially further inwards. This also contributes to keeping the coating powder particles away from the wall of the powder supply channel.

A further advantageous feature is the geometric configuration of the acceleration jet, by which the inlet has an annular groove in the jacket surface, an annular groove in the end face on the inlet side and at least one axial bore in the jet body of the acceleration jet connecting the annular grooves. In this case the acceleration air flows from the annular groove in the end face along the end face of the jet body into its passage. By this means a uniform inflow of acceleration air across the whole area of the passage of the acceleration jet is ensured.

In this embodiment the inlet for the acceleration air can include a narrow, radial gap leading to the inlet side of the passage of the acceleration jet. This gap is delimited on one side by the body of the acceleration jet and on the other side by a second, adjacent component. It is easily accessible for cleaning if needed.

An appropriate configuration of the high-speed rotary atomiser according to the invention is such that the acceleration jet passage first narrows in the flow direction towards a narrowest point and immediately widens again. In this case special external auxiliary means for accelerating the coating powder stream are not in principle required, since the flow restriction alone generates the desired increase in velocity. However, this does not preclude the use of additional acceleration air as mentioned above.

If acceleration air supplied along the end face of the acceleration jet body is used, it is recommended that the acceleration jet passage has a transitional section, formed by a plurality of juxtaposed conical annular surfaces with differing cone angles, extending from the inlet side to the narrowest point. It has emerged that this juxtaposing of conical faces causes less detachment and turbulence of the acceleration air than would be the case with a continuously curved transitional section.

It is also advantageous if the acceleration jet passage widens conically in the flow direction after the narrowest point. The conical widening must take place so slowly that the desired higher velocity is maintained over a sufficient distance. On the other hand, the widening must be so great that after flowing through the narrowest point of the acceleration jet the coating powder stream can be stabilised so that the least possible turbulence arises.

BRIEF DESCRIPTION OF THE DRAWINGS

An embodiment of the invention is explained in more detail below with reference to the drawings, in which.

BEST MODE FOR PRACTICING THE INVENTION

Figure 1:
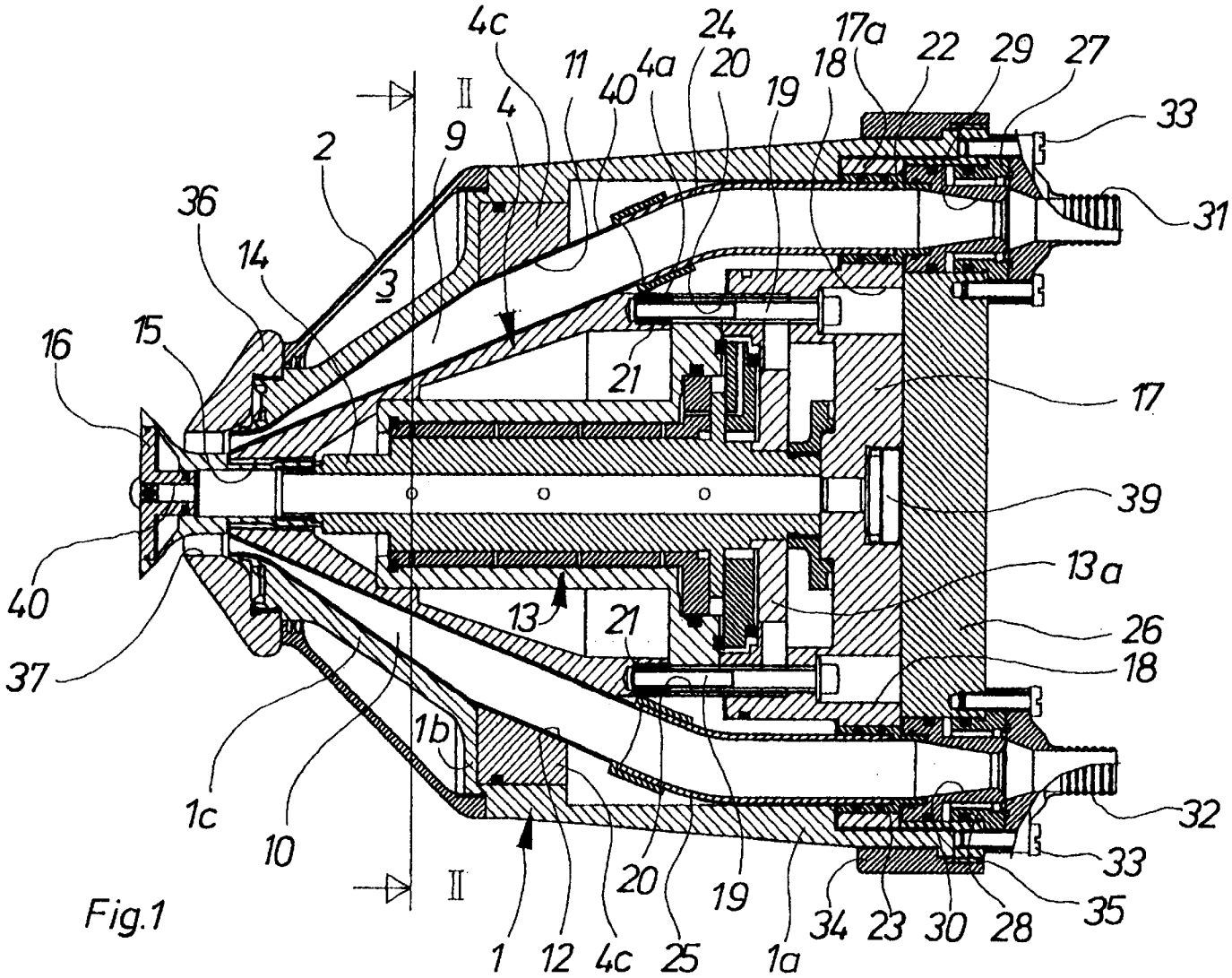
FIG. 1: shows an axial section through a high-speed rotary atomiser.

The high-speed rotary atomiser illustrated in FIG. 1 has a housing 1 composed in one piece of a rear housing section 1*a*, a radial annular shoulder 1*b* and a front housing section 1*c*. Rear housing section 1*a* widens with a small cone angle towards the rear of the high-speed rotary atomiser; front housing section 1*c* is also conical, although its cone angle is larger than that of rear housing section 1*a*. Housing 1 consists entirely of plastics material.

From the radially outer edge of stage 1*b* of the housing a likewise conical annular part 2, also made of plastics material, runs to the front portion of the outer jacket surface of front housing section 1*c*. Annular part 2 is sealed from housing 1 along both its circular edges, so that with housing 1 it encloses an annular space 3. This space serves, in a manner not of interest here, as a passage for guidance air by which the form of the powder cloud produced can be influenced.

An electrode insert 4 is arranged coaxially inside housing 1, and has a cylindrical rear portion 4*a* relatively short in the axial direction and a conical front portion 4*b*. Front portion 4*b* of electrode insert 4 ends in the vicinity of the front end of front housing section 1*c*.

Figure 2:
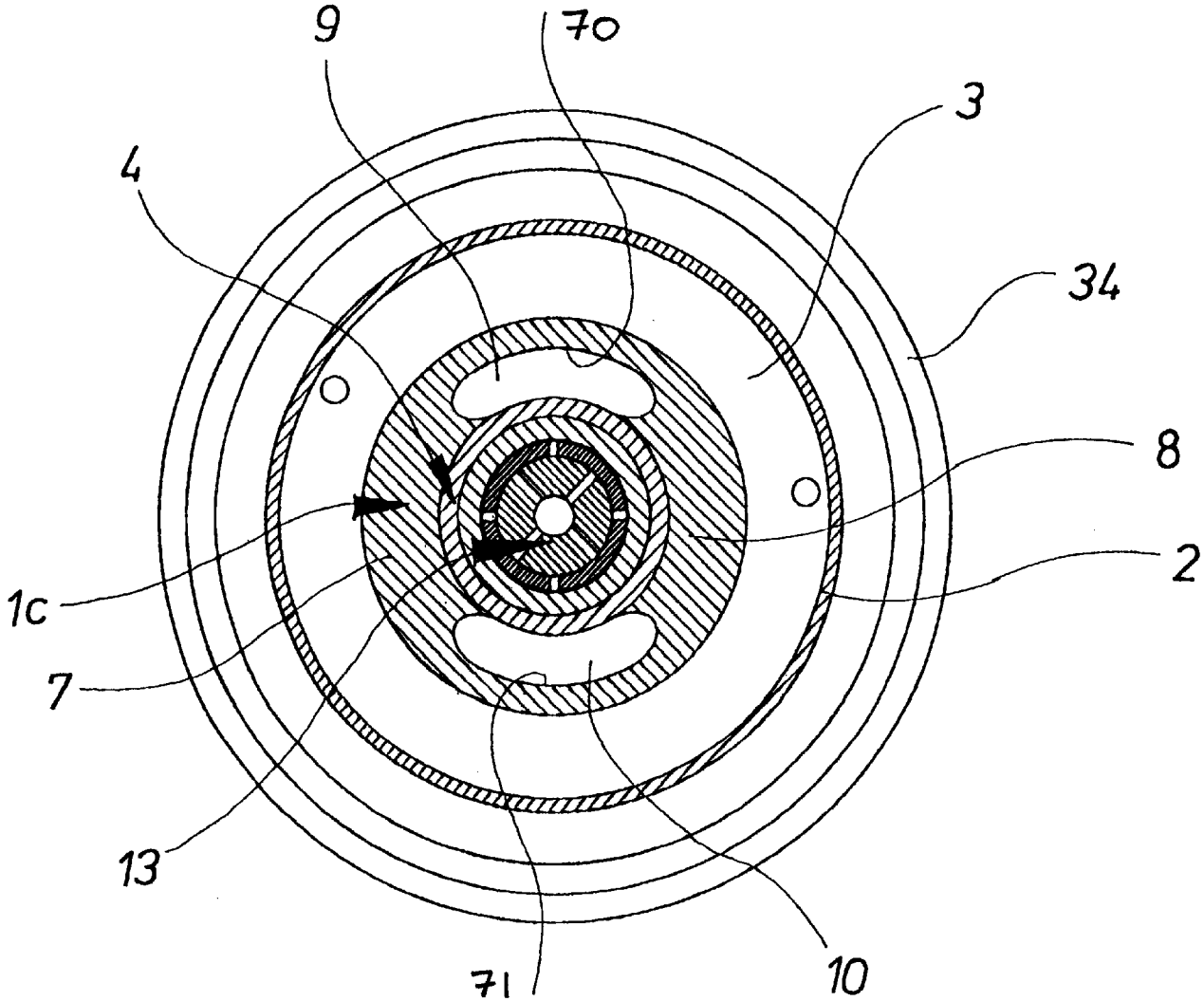
FIG. 2: shows a section through the high-speed rotary atomiser of FIG. 1 along the line II—II.

As shown in FIG. 2, two mirror-symmetrical openings 70, 71 extending from the rear face of stage 1*b* to the front end of front housing section 1*c* and passing from an approximately circular cross-sectional form to the cross-sectional form of an arcuate slot are arranged on the inner jacket surface of front housing section 1*c*. As FIG. 2 makes clear, the conical inner jacket surface of front housing section 1*c* abuts on the conical jacket surface of front section 4*b* of electrode insert 4 via two webs 7,8. In this way front section 4*b* of electrode insert 4 and front housing section 1*c* form two channels 9 and 10. These channels 9, 10 are so inclined with respect to the common axis of housing 1 and electrode insert 4 that they converge towards the front end of the high-speed rotary atomiser.

A radial flange 4*c* extending parallel to annular shoulder 1*b* of housing 1 and abutting on its inner face is moulded on to electrode insert 4 approximately in the transitional portion between front portion 4*b* and rear portion 4*a*. Two openings 11, 12 continuing channels 9, 10 pass through annular flange 4*c*.

An air-driven motor 13, the shaft 14 of which runs coaxially with housing 1 and with electrode insert 4 and passes through a through-bore 15 in electrode insert 4, is inserted in the suitably stepped interior of electrode insert 4. The hub of a bell disc 16 is so locked on to shaft 14 that bell disc 16 rotates together with shaft 14.

Motor 13 is defined by means of a section 13*a* of electrode insert 4 which has a larger radius. This happens because motor section 13*a* is clamped between the rear end face of electrode insert 4 and a pot-shaped retaining insert 17. To this end, retaining insert 17 has stepped bores 18 through which pass screws 19. Screws 19 pass through through-bores 20 in motor section 13*a* and are screwed into threaded bores 21 of electrode insert 4.

Two connector bushes 22, 23 are passed through a radially projecting flange section 17*a* of retaining insert 17. The rearward ends of connecting hoses 24, 25 are attached respectively to each of the connector bushes 22, 23, the front ends of which hoses are connected to a beryllium sheath 40 (FIG. 1), which passes through through-bores 11, 12 in flange section 4*c* of electrode insert 4 and through channels 9, 10 and abuts on the inner faces of said channels. This sheath seals the powder flow channels. Alternatively, this sheath 40 can also be omitted, as illustrated in FIG. 2.

The rearward end of housing 1 is closed by a connector plate 26 which abuts on the rear face of retaining insert 17, which carries various air connections not shown in the drawing and additionally serves as an attachment to the arm of a robot, also not shown. Two acceleration jet inserts 27, 28 pass through connector plate 26 coaxially with connector bushes 22, 23 in retaining insert 17. The precise function of said acceleration jet inserts 27, 28 will be explained below; their passages 29, 30 are aligned respectively with the passages of the adjacent connector bushes 22, 23.

Connector nipples 31, 32 are attached, again with alignment, to the rear faces of acceleration jet inserts 27, 28 respectively, which connector nipples serve as connections to flexible hoses through which the powder is fed from a supply container. Connector nipples 31 and 32 and acceleration jet inserts 27, 28 are so fixed by means of screws 33 to connector plate 26 that after releasing screws 33 connector nipples 31, 32 can first be removed and then acceleration jet inserts 27, 28 can be extracted from connector plate 26.

Connector plate 26 is fixed to housing 1 by means of a union nut 34 which abuts against a circumferential step on housing 1 and is screwed on to an external thread 35 on connector plate 26.

An air guidance body 36, which is not of interest in the present context, is attached to the front end of housing 1. It has a through-bore 27 surrounding the hub of bell disc 16 with clearance.

Figure 3:
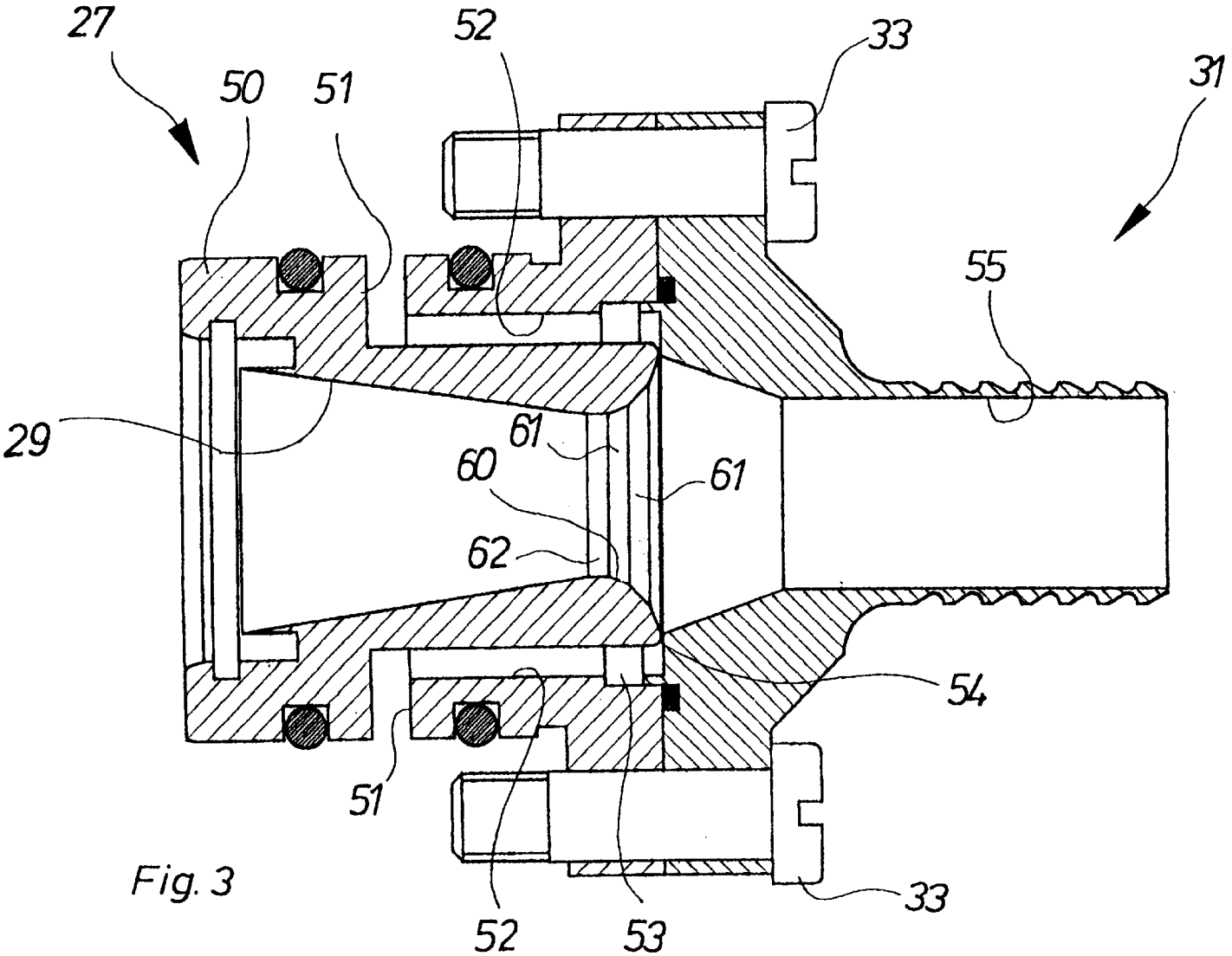
FIG. 3: shows an axial section through an acceleration jet and a connecting nipple of the high-speed rotary atomiser of FIGS. 1 and 2 on an enlarged scale.

Acceleration jet insert 27 and associated connector nipple 31 are illustrated on a larger scale in FIG. 3 and are described in more detail below. The second acceleration jet insert 28 and its connector nipple 32 are formed in an identical manner.

Acceleration jet insert 27 has a jet body 50 in which the above-mentioned passage 29 is formed. In the axial section illustrated in FIG. 3 passage 29 has a form similar to a Lavalle or venturi jet. That is to say that passage 29 first grows narrower from its inlet side located under higher pressure adjacent to connector nipple 31 up to a narrowest point, and from there widens conically over a greater distance up to its outlet side, located on the left in FIG. 3. The narrowing of passage 29 takes place over a transitional section 60 which, seen in axial section, is composed in a polygon-like manner of separate conical annular faces 61 which each have differing cone angles and which pass over into a cylindrical face 62 at the narrowest point.

On its jacket surface jet body 50 of acceleration jet insert 27 has an annular groove 51 which communicates with a supply hole for pressurised acceleration air, not shown in the drawing, passing through connector plate 26. Axial bores 52 lead from annular groove 51 to a second annular groove 53 formed in the end face of jet body 50 adjacent to connector nipple 31. A narrow gap 54 remains between connector nipple 31 and the beginning of passage 29 of jet body 50.

Passage 55 of connector nipple 31 widens in the vicinity of jet body 50 to the diameter of passage 29 in jet body 50 on the inlet side.

The operation of the high-speed rotary atomiser described is as follows:

The coating powder containing electrically conductive particles fed through connector nipples 31, 32 reaches passages 29, 30 of acceleration jet inserts 27, 28 and is already accelerated to a higher velocity because of the narrowing of the cross-sectional area of the stream. This effect is increased by the fact that pressurised acceleration air is admixed via groove 51, axial bores 52, groove 53 in jet body 50 and gap 54 between jet body 50 and connector nipple 31. This acceleration air first enters in a radial direction through gap 54 but is then diverted in an axial direction along transitional section 60 composed of a plurality of conical annular faces 61 and then flows onwards preferably along the wall of passage 29. As this happens it forms a kind of separating air layer between the powder stream and the wall of passage 29. Only at a certain distance in the flow direction beyond the narrowest point 62 of passage 29 of jet body 50 do complete mixing of the acceleration air with the powder stream and a reduction in the flow velocity of the combined streams to a lower value take place. In the intervening section formed primarily by the conical section of passage 29 of jet body 50, but in some cases also by parts of the powder supply channel lying further downstream, the increased flow velocity together with the protective layer of acceleration air prevent particles from being deposited on the walls of the powder supply channel. In this way an electric backflash from electrode insert 4 is reliably prevented.

After leaving acceleration jet inserts 27, 28 the coating powder is fed via hoses 24, 25 into passages 11, 12 and sheaths 40 passing through channels 9, 10. As this happens it brushes along metal surfaces electrically connected to electrode insert 4 and is directly ionised. In this ionised form it now emerges through the two arcuate exit slots located between the front end of housing 1 and the front end of electrode insert 4, passes through through-bore 37 in air conducting body 36 and is then swirled by rotating bell disc 16.

I claim:

1. A high-speed rotary atomiser for applying powder coating comprising:

a housing;

a rotatable bell disc arranged at the front of the housing;

a motor driving the bell disc accommodated in the housing;

at least one powder supply channel passing through the housing and emerging at the front of the housing, the at least one powder supply channel including an acceleration jet in which coating powder particles are accelerated to a higher velocity which is maintained over at least a certain distance; and at least one high-voltage electrode arranged in the housing, the at least one high-voltage electrode positioned so that coating powder particles flowing through the powder supply channel are guided thereto for ionisation.

2. A high-speed rotary atomiser according to claim 1, in which the acceleration jet further comprises an inlet through which pressurised acceleration air can be admitted.

3. A high-speed rotary atomiser according to claim 2, in which the inlet includes an annular groove in a jacket surface, an annular groove in an inlet-side end face and at least one axial bore in a jet body of the acceleration jet connecting the annular grooves.

4. A high-speed rotary atomiser according to claim 2, in which the inlet for the acceleration air includes a relatively narrow radial gap running proximate the inlet of the acceleration jet.

5. A high-speed rotary atomiser according to claim 1, in which the acceleration jet further includes a passage, the passage of the acceleration jet having a configuration which first grows narrower in the flow direction up to a narrowest point and then widens again.

6. A high-speed rotary atomiser according to claim 5, in which the passage of the acceleration jet further includes a transitional section extending proximate the inlet to the narrowest point which is formed by a plurality of juxtaposed conical annular faces with differing cone angles.

7. A high-speed rotary atomiser according to claim 5, in which the passage of the acceleration jet widens conically behind the narrowest section in the direction of flow.

8. A high-speed rotary atomiser for applying powder coating comprising:

a housing;

a rotatable bell disc arranged at the front of the housing;

a motor driving the bell disc accommodated in the housing;

at least one powder supply channel passing through the housing and emerging at the front of the housing, the at least one powder supply channel including an acceleration jet in which coating powder particles are accelerated to a higher velocity which is maintained over at least a certain distance; and at least one high-voltage electrode arranged in the housing positioned downstream of the acceleration jet, the at least one high-voltage electrode positioned so that coating powder particles flowing through the powder supply channel are guided thereto for ionisation.

9. A high-speed rotary atomiser for applying powder coating comprising:

a housing;

a rotatable bell disc arranged at the front of the housing;

a motor driving the bell disc accommodated in the housing;

at least one powder supply channel passing through the housing and emerging at the front of the housing, the at least one powder supply channel including an acceleration jet in which coating powder particles are accelerated to a higher velocity which is maintained over at least a certain distance, the acceleration jet further comprising an inlet through which pressurised acceleration air can be admitted; and at least one high-voltage electrode arranged in the housing, the at least one high-voltage electrode positioned so that coating powder particles flowing through the powder supply channel are guided thereto for ionisation.

* * * * *

UNITED STATES PATENT AND TRADEMARK OFFICE

CERTIFICATE OF CORRECTION

PATENT NO. : 6,722,591 B2
DATED : April 20, 2004
INVENTOR(S) : Reichler

It is certified that error appears in the above-identified patent and that said Letters Patent is hereby corrected as shown below:

Title page,
Item [73], Assignee, should read
-- [73] Assignee: Eisenmann Lacktechnik
(Komplementar: Eisenmann-Stiftung) --

Signed and Sealed this

Third Day of August, 2004

JON W. DUDAS
*Acting Director of the United States Patent and Trademark Office*